US007682292B1

(12) United States Patent
Lo

(10) Patent No.: US 7,682,292 B1
(45) Date of Patent: Mar. 23, 2010

(54) FLYWHEEL-TYPE VARIABLE RESISTANCE GENERATING DEVICE FOR AN EXERCISING APPARATUS

(75) Inventor: Wen-Hai Lo, Miaoli County (TW)

(73) Assignee: Giant Manufacturing Co., Ltd., Ta Chia Chen, Taichung Hsien (TW)

( * ) Notice: Subject to any disclaimer, the term of this patent is extended or adjusted under 35 U.S.C. 154(b) by 0 days.

(21) Appl. No.: 12/320,566

(22) Filed: Jan. 29, 2009

(51) Int. Cl.
*A63B 22/06* (2006.01)
*B60W 10/02* (2006.01)
*B60W 10/18* (2006.01)

(52) U.S. Cl. ..... 482/57; 482/63; 74/471 R; 188/344

(58) Field of Classification Search ..... 482/57–65, 482/117–120; 192/13 R; 74/471 R; 188/344
See application file for complete search history.

(56) References Cited

U.S. PATENT DOCUMENTS 4,289,309 A * 9/1981 Hoffmann ..... 482/63
4,920,782 A * 5/1990 Hellwig ..... 72/451
4,953,415 A * 9/1990 Lehtonen ..... 74/141
5,031,901 A * 7/1991 Saarinen ..... 482/63
6,749,544 B1 * 6/2004 Chen ..... 482/57
7,395,909 B2 * 7/2008 Hutchison ..... 192/13 R

* cited by examiner

*Primary Examiner*—Steve R Crow
(74) *Attorney, Agent, or Firm*—Harness, Dickey & Pierce, P.L.C.

(57) ABSTRACT

A flywheel-type variable resistance generating device for an exercising apparatus includes two actuating arms disposed outboard of a flywheel, a pulling cord having two anchoring ends coupled with a tightening-force adjusting member and a lever, and two pull-activating members connected to the pulling cord so as to move the actuating arms. The actuating arms are movable among a starting position where they are disengaged from the flywheel, an adjusted position where they are partially engaged with the flywheel, and a braking position where they are fully engaged with the flywheel. When the lever is operated to move one anchoring end with a braking force, the other anchoring end of the pulling cord is pulled back to its initial locus to move the actuating arms to the starting position.

7 Claims, 6 Drawing Sheets

FLYWHEEL-TYPE VARIABLE RESISTANCE GENERATING DEVICE FOR AN EXERCISING APPARATUS

BACKGROUND OF THE INVENTION

1. Field of the Invention

This invention relates to an exercising apparatus, more particularly to a flywheel-type variable resistance generating device for an exercising apparatus.

2. Description of the Related Art

Referring to FIGS. 1 and 2, a conventional exercising bicycle 1 is shown to include a frame 11, a flywheel 12 and a swing arm 13 pivotably mounted on the frame 11, a braking pad 14 pivoted to one end of the swing arm 13 and confronting the rim of the flywheel 12, a resistance generating unit 15, and a pedal unit 16 operable by a user to drive rotation of the flywheel 12. The resistance generating unit 15 has a sleeve tube 151 extending through the frame 11, an inner tube 152 extending through the sleeve tube 151 and pivoted to the other end of the swing arm 13, and a lever 153 pivoted to the sleeve tube 151, and a threaded bolt 154 threadedly engaging the inner tube 152.

During pedaling, the user can turn the threaded bolt 154 to lift the inner tube 152 so as to swing the swing arm 13 for adjusting the friction force between the braking pad 14 and the flywheel 12, thereby generating variable levels of resistance. When it is desired to immediately stop rotation of the flywheel 12, the lever 153 is pressed to lift the inner tube 152 through the threaded bolt 154 so as to swing the swing arm 13 for retarding the rotation of the flywheel 12 while preventing the user from undesirably touching the pedal unit 16.

When the rotation of the flywheel 12 is stopped, since the threaded bolt 154 is prevented from moving by the threaded engagement with the inner tube 152, the user must rotate the threaded bolt 154 back to its initial position before resuming pedaling, which is inconvenient to the user.

SUMMARY OF THE INVENTION

An object of the present invention is to provide a flywheel-type variable resistance generating device for an exercising apparatus which can generate variable levels of resistance to a flywheel and which can be adjusted to a resistance-free state when rotation of the flywheel is stopped.

According to this invention, the flywheel-type variable resistance generating device for an exercising apparatus includes a flywheel, left and right actuating arms, left and right anchored mounts, a pulling cord, a tightening-force adjusting member, a biasing unit, left and right pull-activating members, and a lever.

The flywheel is adapted to be suspended by a frame support of the exercising apparatus to be rotatable about a wheel axis.

The left and right actuating arms respectively include left and right pivot ends which are adapted to be mounted pivotally on the frame support, left and right pulled ends which extend to confront each other to be moved among a starting position, an adjusted position, and a braking position, where the left and right pulled ends are away from, close to, closer to each other, respectively, left and right mount segments disposed respectively between the left pulled and pivot ends and between the right pulled and pivot ends, and left and right speed-retarding members which are respectively secured to the left and right mount segments so as to be moved with the left and right pulled ends, respectively. The left and right speed-retarding members respectively have left and right friction surfaces which are respectively fully engaged with left and right major walls of the flywheel in the braking position, which are partially engaged with the left and right major walls in the adjusted position, and which are disengaged from the left and right major walls in the starting position.

The left and right anchored mounts are adapted to be disposed on the frame support, and are respectively spaced apart from the left and right pulled ends to cooperatively define a guiding route that extends from the left anchored mount through the left and right pulled ends to the right anchored mount.

The pulling cord is led to pass through the guiding route to permit left and right anchoring ends thereof to be pullably retained at the left and right anchored mounts, respectively, in the starting position.

The tightening-force adjusting member is coupled with the left anchoring end such that, when the pulling cord is moved from the starting position to the adjusted position, the left anchoring end is pulled away from the left anchored mount so as to displace from an initial locus to an adjusted locus, and is configured to be retained relative to the frame support so as to permit the left anchoring end to be held in the adjusted locus against a pulling force of the pulling cord which is generated as a result of the displacement of the left anchoring end.

The biasing unit is disposed to bias the left and right pulled ends to the starting position.

The left and right pull-activating members are disposed to transmit the pulling force to the left and right pulled ends so as to move the left and right pulled ends to the adjusted position against the biasing action of the biasing unit.

The lever is mounted pivotally on the right anchored mount, and is operable to move the right anchoring end away from the right anchored mount so as to permit the left and right pulled ends to continue moving against the biasing action to the braking position, and so as to pull the left anchoring end back to the initial locus.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
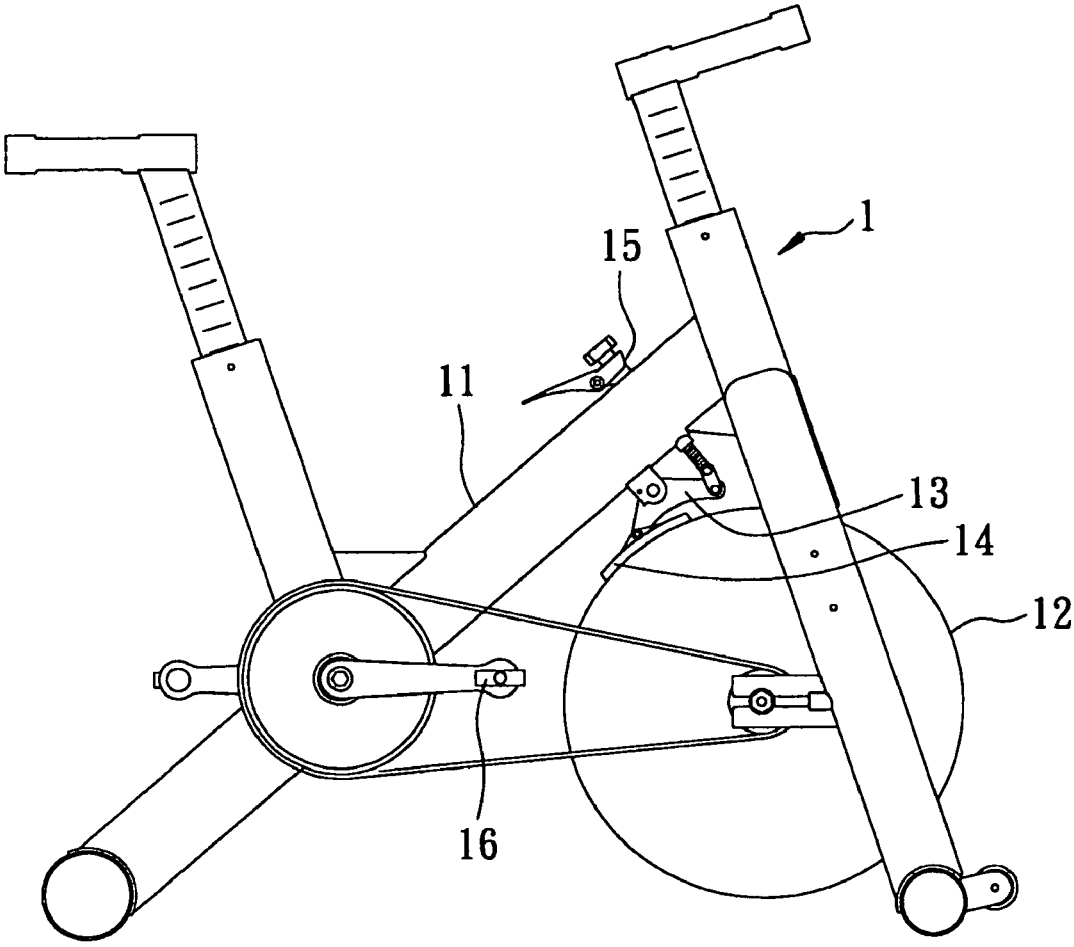
FIG. 1 PRIOR ART
FIG. 1 is a schematic side view of a conventional exercising bicycle.
Figure 2:
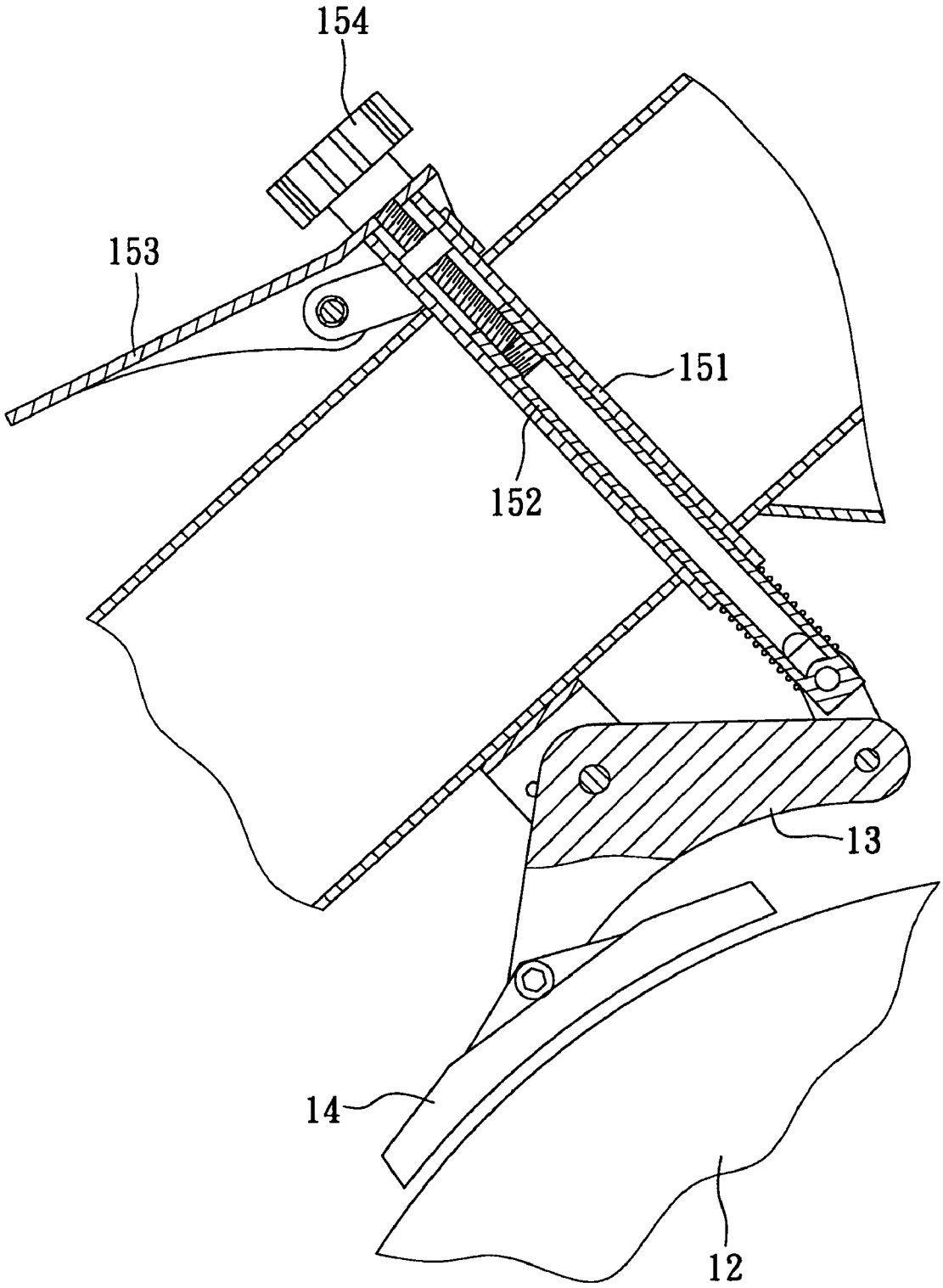
FIG. 2 PRIOR ART
FIG. 2 is a fragmentary sectional view showing a resistance generating unit of the conventional exercising bicycle.
Figure 3:
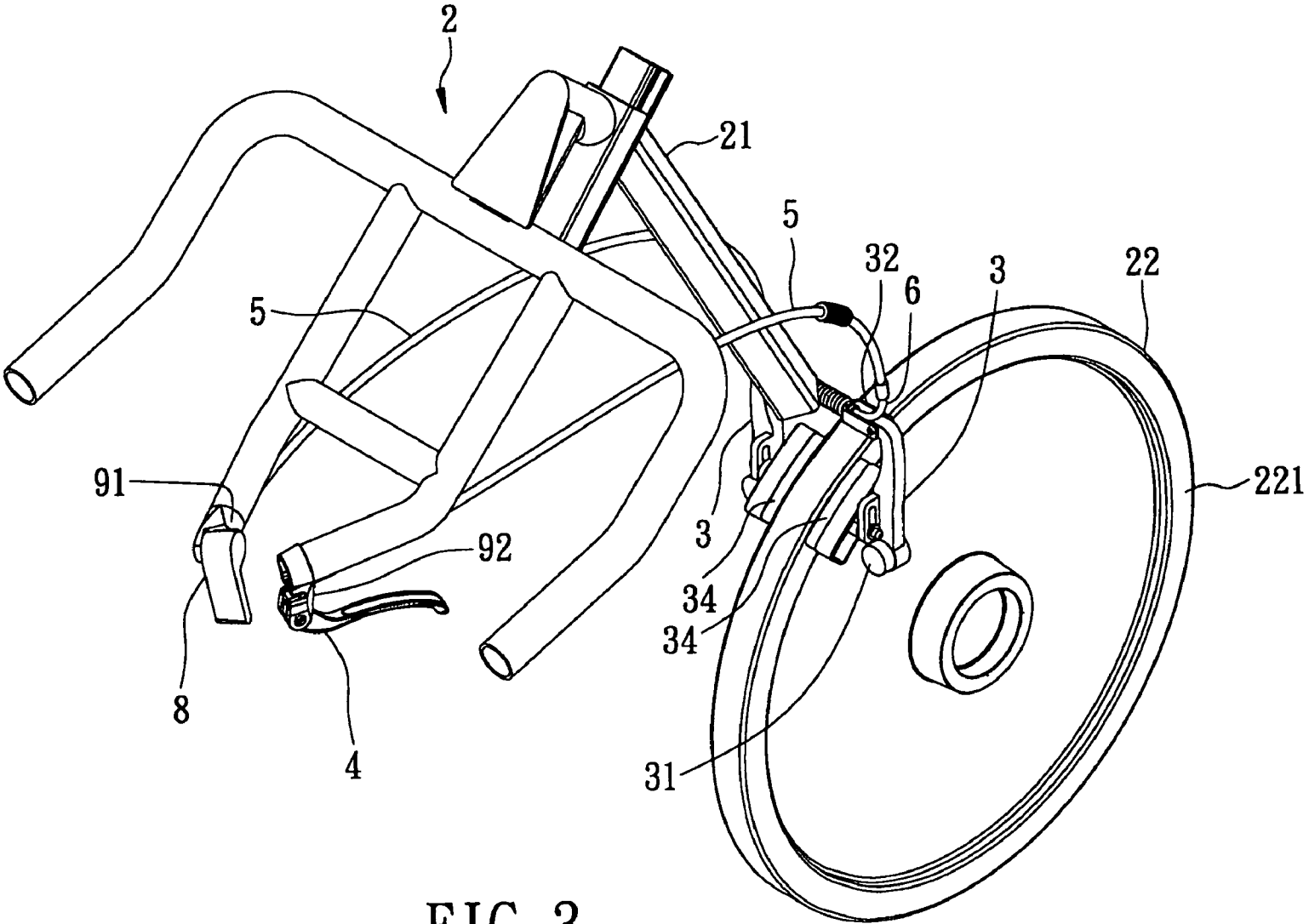
FIG. 3 is a perspective view of the preferred embodiment of a flywheel-type variable resistance generating device according to this invention when mounted on a frame support of an exercising apparatus.
Figure 4:
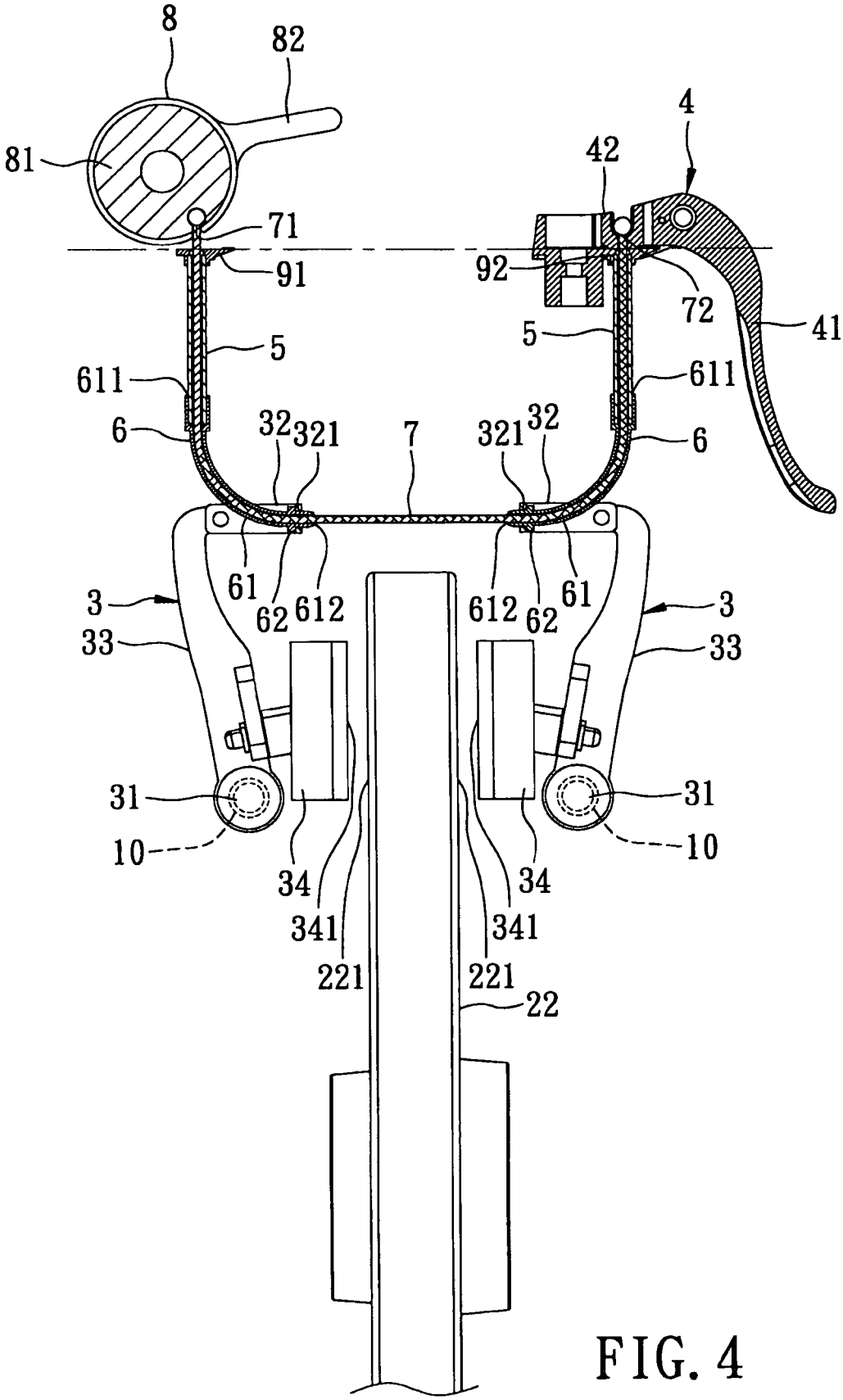
FIG. 4 is a sectional view showing the preferred embodiment in an initial state.

Referring to FIGS. 3 and 4, the preferred embodiment of a flywheel-type variable resistance generating device according to the present invention is adapted for use in an exercising apparatus 2, such as an exercising bicycle which includes a frame support 21 for mounting of a pedal unit (not shown) that is operable by a user to perform cyclic movement. The flywheel-type variable resistance generating device is shown to comprise a flywheel 22, left and right actuating arms 3, left and right anchored mounts 91,92, a pulling cord 7, a tightening-force adjusting member 8, a biasing unit, left and right pull-activating members 6, left and right protective tubes 5, and a lever 4.

The flywheel 22 is adapted to be suspended from the ground by the frame support 2 to be rotatable about a wheel axis with the cyclic movement of the pedal unit, and has left and right major walls 221 opposite to each other in an axial direction parallel to the wheel axis.

The left and right actuating arms 3 respectively include left and right pivot ends 31, left and right pulled ends 32, left and right mount segments 33, and left and right speed-retarding members 34. The left and right pivot ends 31 are adapted to be mounted pivotally on the frame support 21 about left and right pivot axes, respectively, and in a longitudinal direction transverse to the axial direction, and are disposed outboard of the left and right major walls 221 of the flywheel 22, respectively. The left and right pulled ends 32 are disposed opposite to and are pivotably connected relative to the left and right pivot ends 31, respectively, and extend to confront each other in the axial direction so as to be moved among a starting position where the pulled ends 32 are away from each other, an adjusted position where the pulled ends 32 are close to each other, and a braking position where the pulled ends 32 are closer to each other. The left mount segment 33 is disposed between the left pulled and pivot ends 32,31, and the right mount segment 33 is disposed between the right pulled and pivot ends 32,31. The left and right speed-retarding members 34 are respectively secured to the left and right mount segments 33 so as to be moved with the left and right pulled ends 32, respectively, and respectively have left and right friction surfaces 341. In the braking position, the friction surfaces 341 are fully engaged with the major walls 221 of the flywheel 22. In the adjusted position, the friction surfaces 341 are partially engaged with the major walls 221. In the starting position, the friction surfaces 341 are disengaged from the major walls 221.

The left and right anchored mounts 91,92 are adapted to be disposed on the frame support 21, and are respectively spaced apart from the left and right pulled ends 32 of the left and right actuating arms 3 to cooperatively define a guiding route that extends from the left anchored mount 91 through the left and right pulled ends 32 to the right anchored mount 92.

The pulling cord 7 has left and right anchoring ends 71,72, and is led to pass through the guiding route to permit the left and right anchoring ends 71,72 to be pullably retained at the left and right anchored mounts 91,92, respectively, in the starting position.

The tightening-force adjusting member 8 has a rotary body 81 adapted to be pivotally mounted on the frame support 21 about a rotating axis, and a grip 82 disposed on the rotary body 81 and operable by the user so as to turn the rotary body 81. The rotary body 81 is coupled with the left anchoring end 71 of the pulling cord 7, and has a toothed peripheral surface which is engaged with a spring-biased pin (not shown) that is pivoted to the frame support 21 adjacent to the left anchored mount 91, and which defines initial and adjusted loci that are respectively close to and remote from the left anchored mount 91, and that are angularly displaced from each other about the rotating axis. When the rotary body 81 is turned about the rotating axis to move the pulling cord 7 from the starting position to the adjusted position, the left anchoring end 71 is pulled away from the left anchored mount 91 so as to displace from the initial locus to the adjusted locus, and so as to be held in the adjusted locus by the engagement of the peripheral surface with the spring-biased pin against a pulling force of the pulling cord 7 which is generated as a result of the displacement of the left anchoring end 71.

The biasing unit includes left and right coil springs 10 which are disposed to surround the left and right pivot ends 31 of the left and right actuating arms 3, respectively, and to bias the left and right pulled ends 32 away from each other to the starting position.

Each of the left and right pull-activating members 6 includes a bent guiding tube 61 which is made from a material that is non-compressible in a lengthwise direction, which extends along the guiding route for passage of the pulling cord 7 therethrough, and which terminates at an abutting end 611 and a coupled end 612, and a coupling portion having a flange 62 which is disposed on the coupled end 612. The abutting end 611 confronts, and is kept unmoved relative to, the respective anchored mount 91,92 in an upright direction transverse to both the axial and longitudinal directions. The coupled end 612 is disposed adjacent to the respective pulled end 32, and is oriented in the axial direction. In addition, each of the left and right pulled ends 32 has a barrier 321 which is disposed adjacent to the respective coupled end 612 such that the corresponding flange 62 flanks and engages the barrier 321 to transmit the pulling force to the respective pulled end 32, thereby enabling the left and right pulled ends 32 to move to the adjusted position against the biasing action of the coil springs 10.

Each of the left and right protective tubes 5 interconnects the abutting end 611 of the respective bent guiding tube 61 and the respective anchored mount 91,92 so as to cooperate with the respective bent guiding tube 61 to define the guiding route.

Figure 5:
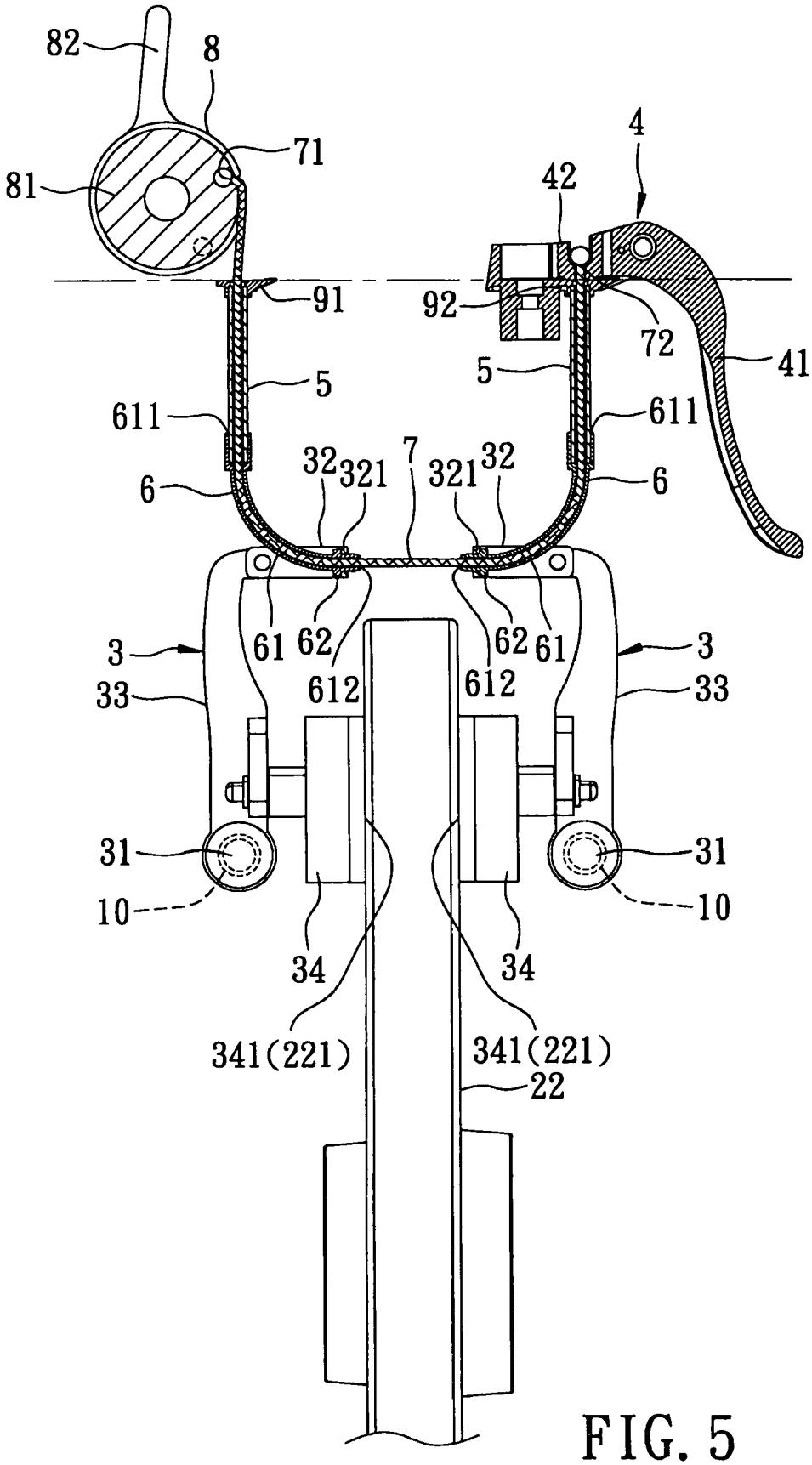
FIG. 5 is a sectional view showing the preferred embodiment in a resistance adjusted state.

The lever 4 is mounted pivotally on the right anchored mount 92, and includes a power end 41 for exertion of a braking force by the user, and a weight end 42 coupled with the right anchoring end 72 of the pulling cord 7 and configured to be actuated by the braking force to lift the right anchoring end 72 away from the right anchored mount 92 so as to permit the left and right pulled ends 32 of the actuating arms 3 to continue moving to the braking position, and so as to pull the left anchoring end 71 back to the initial locus. Referring to FIG. 5, during the cyclic pedaling movement of the pedal unit by the user, the user can turn the rotary body 81 to reel in the pulling cord 7 so as to move the pulled ends 32 towards each other to the adjusted position, where the speed-retarding members 34 are respectively and partially engaged with the major walls 221 of the flywheel 22 to thereby generate a resistance force.

Figure 6:
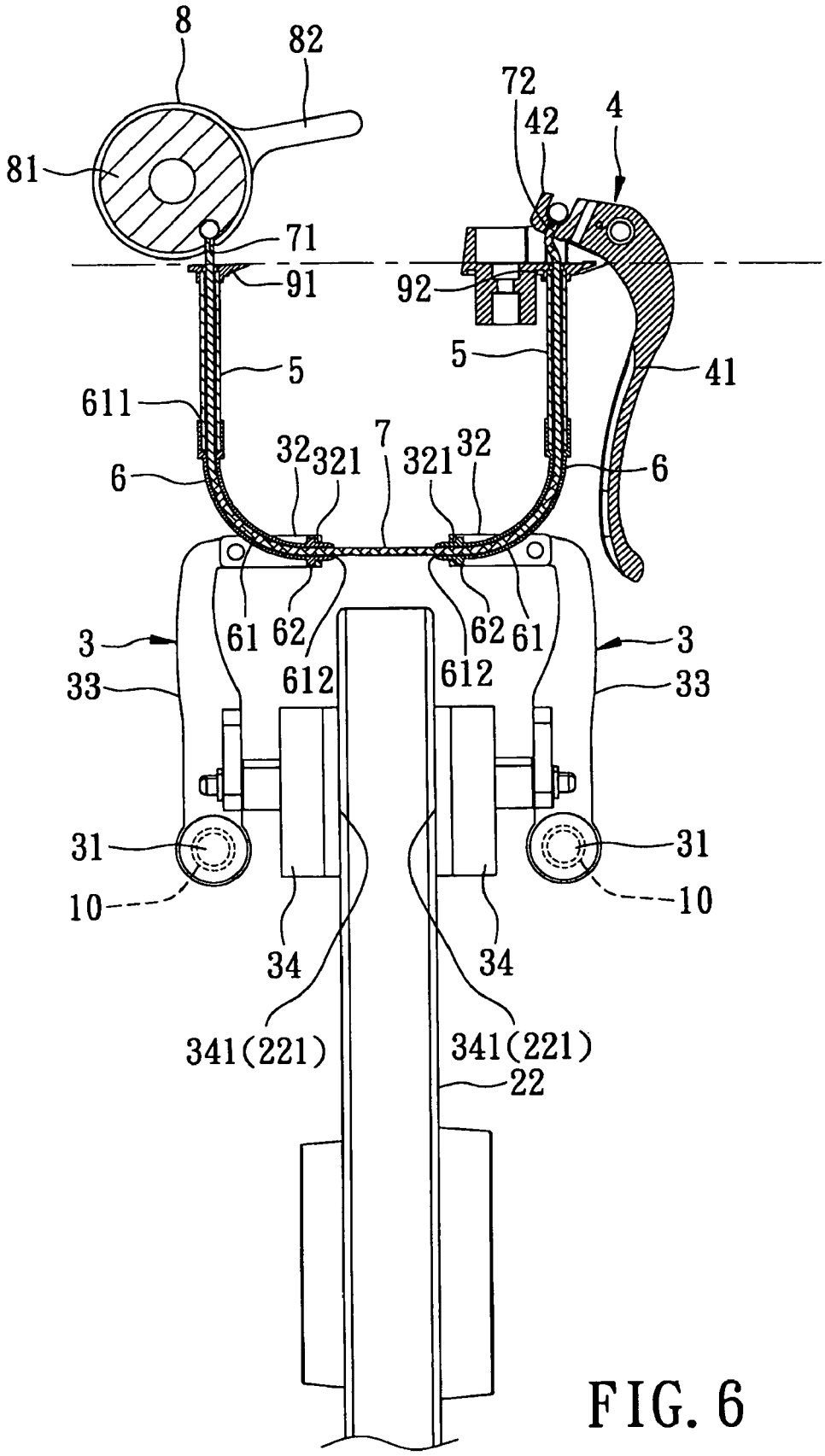
FIG. 6 is a sectional view showing the preferred embodiment in a braking state.

Referring to FIG. 6, when it is desired to quickly stop rotation of the flywheel 22, the user can press the power end 41 of the lever 4 to pull the right anchoring end 72 of the pulling cord 7 away from the right anchored mount 92 such that the rotary body 81 is actuated to turn in a reel-off direction to release the pulling cord 7 reeled on the rotary body 81, thereby moving the left anchoring end 71 to return to its initial locus. Meanwhile, the left and right pulled ends 32 are further moved to the braking position, so that the rotation of the flywheel 22 is stopped by the frictional engagement between the friction surfaces 341 and the major walls 221. Thereafter, when the user releases the lever 4, the left and right pulled ends 32 will be moved back to the starting position by the biasing action of the coil springs 10, as shown in FIG. 4.

As illustrated, when a braking force is applied to the lever 4 to stop the rotation of the flywheel 22, the actuating arms 3 are moved back to the starting position where the friction surfaces 341 are disengaged from the flywheel 22. Thus, no resistance is generated to the flywheel 22 at this stage, thereby rendering it easier for the user to resume pedaling.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A flywheel-type variable resistance generating device for an exercising apparatus which includes a frame support, said flywheel-type variable resistance generating device comprising:

a flywheel which is adapted to be suspended from the ground by the frame support to be rotatable about a wheel axis, and which has left and right major walls opposite to each other in an axial direction parallel to the wheel axis;

left and right actuating arms respectively including left and right pivot ends which are adapted to be mounted pivotally on the frame support about left and right pivot axes, respectively, and in a longitudinal direction transverse to the axial direction, and which are disposed outboard of said left and right major walls, respectively, left and right pulled ends which are disposed opposite to said left and right pivot ends, respectively, and which extend to confront each other in the axial direction so as to be moved among a starting position where said left and right pulled ends are away from each other, an adjusted position where said left and right pulled ends are close to each other, and a braking position where said left and right pulled ends are closer to each other, a left mount segment disposed between said left pulled and pivot ends, and a right mount segment disposed between said right pulled and pivot ends, and left and right speed-retarding members which are respectively secured to said left and right mount segments so as to be moved with said left and right pulled ends, respectively, and which respectively have left and right friction surfaces which are respectively fully engaged with said left and right major walls in the braking position, which are partially engaged with said left and right major walls in the adjusted position, and which are respectively disengaged from said left and right major walls in the starting position;

left and right anchored mounts which are adapted to be disposed on the frame support, and which are respectively spaced apart from said left and right pulled ends to cooperatively define a guiding route that extends from said left anchored mount through said left and right pulled ends to said right anchored mount;

a pulling cord which has left and right anchoring ends, and which is led to pass through said guiding route to permit said left and right anchoring ends to be pullably retained at said left and right anchored mounts, respectively, in the starting position;

a tightening-force adjusting member which is coupled with said left anchoring end such that, when said pulling cord is moved from the starting position to the adjusted position, said left anchoring end is pulled away from said left anchored mount so as to displace from an initial locus to an adjusted locus, and which is configured to be retained relative to the frame support so as to permit said left anchoring end to be held in the adjusted locus against a pulling force of said pulling cord which is generated as a result of the displacement of said left anchoring end;

a biasing unit disposed to bias said left and right pulled ends to the starting position;

left and right pull-activating members disposed to transmit the pulling force to said left and right pulled ends, respectively, so as to move said left and right pulled ends to the adjusted position against the biasing action of said biasing unit; and a lever mounted pivotally on said right anchored mount, and operable to move said right anchoring end away from said right anchored mount so as to permit said left and right pulled ends to continue moving against the biasing action to the braking position, and so as to pull said left anchoring end back to the initial locus.

2. The flywheel-type variable resistance generating device according to claim 1, wherein said lever includes a power end for exertion of a braking force by a user, and a weight end coupled with said left anchoring end of said pulling cord and configured to be actuated by the braking force so as to lift said right anchoring end away from said right anchored mount.

3. The flywheel-type variable resistance generating device according to claim 1, wherein said tightening-force adjusting member has a rotary body adapted to be pivotally mounted on the frame support about a rotating axis, and having a peripheral surface which defines said initial and adjusted loci that are angularly displaced from each other about the rotating axis and that are respectively close to and remote from said left anchored mount, and which is retained relative to said left anchored mount so as to hold said left anchoring end in the adjusted locus, said tightening-force adjusting member further having a grip disposed on said rotary body and operable by the user to turn said rotary body.

4. The flywheel-type variable resistance generating device according to claim 1, wherein said biasing unit has left and right coil springs which are disposed to surround said left and right pivot ends, respectively, and to bias said left and right pulled ends away from each other.

5. The flywheel-type variable resistance generating device according to claim 1, wherein each of said left and right pull-activating members includes a bent guiding tube that is made from a material which is non-compressible in a lengthwise direction, that extends along the guiding route for passage of said pulling cord therethrough, and that terminates at an abutting end which confronts, and which is kept unmoved relative to, a corresponding one of said left and right anchored mounts in an upright direction transverse to both the axial and longitudinal directions, and at a coupled end which is disposed adjacent to a corresponding one of said left and right pulled ends, and which is oriented in the axial direction, and a coupling portion disposed between said coupled end and the respective one of said left and right pulled ends for transmitting the pulling force to the respective one of said left and right pulled ends.

6. The flywheel-type variable resistance generating device according to claim 5, wherein each of said left and right pulled ends has a barrier which is disposed adjacent to said coupled end, said coupling portion having a flange which is disposed on said coupled end and which is disposed to flank and engage said barrier so as to transmit the pulling force to the respective one of said left and right pulled ends.

7. The flywheel-type variable resistance generating device according to claim 5, further comprising left and right protective tubes, each of which interconnects said abutting end of said bent guiding tube of a respective one of said left and right pull-activating members and a respective one of said left and right anchored mounts so as to cooperate with said bent guiding tube to define the guiding route.

* * * * *